US011828562B1

(12) United States Patent
Guo

(10) Patent No.: US 11,828,562 B1
(45) Date of Patent: Nov. 28, 2023

(54) CARTRIDGE FEEDING SYSTEM FOR GUN

(71) Applicant: Xuyang Guo, Beijing (CN)

(72) Inventor: Xuyang Guo, Beijing (CN)

( * ) Notice: Subject to any disclaimer, the term of this patent is extended or adjusted under 35 U.S.C. 154(b) by 0 days.

(21) Appl. No.: 18/327,476

(22) Filed: Jun. 1, 2023

(51) Int. Cl.
*F41A 9/00* (2006.01)
*F41A 9/70* (2006.01)
*F41A 9/69* (2006.01)

(52) U.S. Cl.
CPC .. *F41A 9/70* (2013.01); *F41A 9/69* (2013.01)

(58) Field of Classification Search
CPC ..... F41A 9/55; F41A 9/73; F41A 3/66; F41A 7/10; F41A 9/74; F41A 3/26; F41A 9/75; F41A 17/38; F41A 19/13; F41A 19/46; F41A 9/66–71
USPC ..... 42/50, 49.01, 18, 49.02, 7, 87, 90, 6
See application file for complete search history.

(56) References Cited

U.S. PATENT DOCUMENTS 2,935,914 A * 5/1960 Darsie ..... F41A 9/74 89/33.02
3,296,930 A * 1/1967 Rocha ..... F41A 9/51 89/33.01
4,384,508 A * 5/1983 Sullivan ..... F41A 17/38 89/33.02
4,445,418 A * 5/1984 Sullivan ..... F41A 9/73 89/33.02
4,487,103 A * 12/1984 Atchisson ..... F41A 9/73 89/33.02
4,587,879 A * 5/1986 Savioli ..... F41A 9/55 89/33.04
4,708,049 A * 11/1987 Durant ..... F41A 9/35 89/33.17
4,807,513 A * 2/1989 Post ..... F41A 3/50 89/187.01
4,831,914 A * 5/1989 Dardick ..... F41A 9/46 89/33.02
4,888,900 A * 12/1989 Howard ..... F41A 9/70 42/50
4,930,238 A * 6/1990 Poff, Jr. ..... F41A 19/13 42/16
4,934,244 A * 6/1990 Johnson, Jr. ..... F41A 7/10 42/39.5
5,765,302 A * 6/1998 Brandl ..... F41A 9/55 42/18
5,827,991 A * 10/1998 Predazzer ..... F41A 5/16 89/178
9,618,290 B1 * 4/2017 Redmon ..... F41A 9/76
10,094,630 B1 * 10/2018 Loveday, IV ..... F41A 9/65
11,326,860 B1 * 5/2022 Guo ..... F42B 14/02
(Continued)

*Primary Examiner* — Michael D David
(74) *Attorney, Agent, or Firm* — MH2 TECHNOLOGY LAW GROUP, LLP

(57) ABSTRACT

Disclosed is a novel cartridge feeding system for a gun, relating to the technical field of guns. The system comprises a gun barrel, a chamber, a grip, and a trigger set. A feeding rail is arranged between the grip and the chamber, the trigger set is located at the bottom of the feeding rail, and one end, away from the grip, of the trigger set is provided with a magazine. The upper side of the magazine is connected to the inner bottom of the feeding rail, a rotatable feeding ramp is hinged to the bottom of one end, close to the feeding rail, of the chamber, a bolt is movably arranged in an upper half part of the feeding rail, and a movable cartridge extraction/pushing hook is hinged to the bottom of one end, close to the chamber, of the bolt.

6 Claims, 7 Drawing Sheets

(56) References Cited

U.S. PATENT DOCUMENTS

| | | | | |
|---|---|---|---|---|
| 11,402,165 | B1 * | 8/2022 | Besselink | F41A 3/86 |
| 11,635,267 | B1 * | 4/2023 | Rosenblum | F41A 9/83 42/87 |
| 2011/0078937 | A1 * | 4/2011 | Rich | F41A 9/73 89/33.1 |
| 2011/0079132 | A1 * | 4/2011 | Rich | F41A 9/74 89/33.02 |
| 2012/0073179 | A1 * | 3/2012 | Young | F41A 21/485 42/75.02 |
| 2012/0160083 | A1 * | 6/2012 | Rael | F41A 9/75 89/33.02 |
| 2012/0180354 | A1 * | 7/2012 | Sullivan | F41A 21/48 42/16 |
| 2015/0330730 | A1 * | 11/2015 | Stone | F41C 23/18 89/33.01 |
| 2016/0341504 | A1 * | 11/2016 | Mochak | F41A 9/24 |
| 2020/0256630 | A1 * | 8/2020 | Rosenblum | F41A 9/51 |
| 2023/0152051 | A1 * | 5/2023 | Gibbens | F41C 7/00 89/138 |

* cited by examiner

CARTRIDGE FEEDING SYSTEM FOR GUN

TECHNICAL FIELD

The present disclosure relates to the technical field of guns, and in particular relates to a novel cartridge feeding system for a gun.

BACKGROUND

The existing gun cartridge feeding means that the bolt directly pushes the cartridge forwards into the chamber for cartridge feeding. The defect is that the cartridge storage device (magazine as an example) must be located behind the chamber to make the gun structure have a certain limitation, leading to the situation that the pistol cartridges are hard to increase their size to deal with the rapidly developed body armor. If the cartridges are sized up in the current auto loading structure, the magazine may be oversized, leading to the situation that the grip is too large to hold or the magazine has to be placed in front of the grip. Moreover, the portability is affected as the result of increasing the size of cartridges due to the traditional structure, and the cartridges with small size cannot provide enough penetration or deliver enough kinetic energy, and thus the traditional self-loading pistol with small cartridge cannot effectively shoot the target with hard body armor.

SUMMARY

An objective of the present disclosure is to provide a novel cartridge feeding system for a gun to solve the problem in the prior art. A magazine is separately arranged in front of the trigger set, and thus the size of the magazine can be increased without being constrained by the grip, and the size of the cartridge can be increased. Due to the existence of the novel structure, there is no significant increase in size over the gun with traditional cartridge feeding structure which uses the same the size of the cartridge, and thus the portability cannot be affected.

To achieve the objective above, the present disclosure provides the following solutions:

A novel cartridge feeding system for a gun includes a gun barrel, a chamber, a grip, and a trigger set. A feeding rail is arranged between the grip and the chamber, the trigger set is located at the bottom of the feeding rail, and one end, away from the grip, of the trigger set is provided with a magazine. The upper side of the magazine communicates with the inner bottom of the feeding rail, and a rotatable feeding ramp is hinged to the bottom of one end, close to the feeding rail, of the chamber. A bolt is movably arranged in the upper half part of the feeding rail, a movable cartridge extraction/pushing hook is hinged to the bottom of one end, close to the chamber, of the bolt, and the locking and self-loading structure of the bolt may apply any known structures, which will not be described in detail, and is simply illustrated with a cylinder. It is only necessary to place the movable cartridge extraction/pushing hook underneath, so that the cartridge can be completely extracted from the magazine by the movable cartridge extraction/pushing hook and then pulled to the rotatable feeding ramp to be lifted up, and thus the continuous cartridge pulling is stopped; while the bolt continues to move backwards, and when the bolt moves forwards, the movable cartridge extraction/pushing hook is put down again to push the cartridge into the chamber.

Alternately, the feeding rail includes a feeding rail upper part and a feeding rail lower part which are connected with each other, the central line of the feeding rail upper part coincides with the central line of the chamber, and the bolt can move horizontally on the feeding rail upper part.

Alternately, the chamber is a hollow cylindrical structure. The feeding rail upper part includes an integrally-formed gradual-change part with an open bottom, one end of the gradual-change part is connected to the chamber, the other end of the gradual-change part is provided with an ejector part for an empty case, and an ejector port is formed in one side of the ejector part.

Alternately, the gradual-change part includes a feeding rail contraction part connected to the chamber; one end, far away from the chamber, of the feeding rail contraction part is provided with a feeding rail transition part and a feeding rail rear part in sequence, the cross sections of the feeding rail contraction part and the feeding rail transition part are both inverted U-shaped, and the width of the feeding rail transition part is equal to that of the feeding rail lower part. A bottom notch part of the feeding rail contraction part is configured to push the cartridge from the feeding rail lower part to the feeding rail upper part, and the contraction of the feeding rail contraction part with respect to the feeding rail transition part is to gather the cartridges at two possible positions of double-stack feed in the middle and push the cartridge into the same position. The width of the feeding rail transition part is equal to that of the feeding rail lower part, so that when tilted from the feeding rail lower part and pushed into the feeding rail upper part, the cartridge continues to move forwards while being forced to gather in the middle. The longitudinal section of the feeding rail rear part is a circular structure with an open bottom, the inner diameter of the feeding rail rear part is slightly greater than the inner diameter of the chamber so as to accommodate the bolt, and an opening at the lower end is configured to reserve a movement space for the cartridge extraction of the movable cartridge extraction/pushing hook below the bolt. The bolt can reciprocate in the feeding rail rear part.

Alternately, the rotatable feeding ramp includes a connecting rod part hinged to the tail end of the chamber, one end of the connecting rod part away from the hinge point with the chamber is integrally formed with a baffle part, and a gap is provided between a vertical projection of one side, away from the connecting rod part, of the baffle part and a vertical projection of the movable cartridge extraction/pushing hook.

Alternately, the height of the ejector port is greater than the diameter of the cartridge, and the length of the ejector port is greater than the length of the cartridge.

Compared with the prior art, the present disclosure obtains the following technical effects:

The magazine can be moved forwards without moving the position of the chamber forwards. By utilizing the reciprocation of the bolt that the bolt moves backwards to extract the cartridge and moves forwards to push the cartridge into the chamber, the space is more saved compared with the traditional structure of directly pushing the cartridge into the chamber, and the overall structure limitation of the gun is reduced. The present disclosure may save the space and the magazine can be moved to the front of the chamber, so that the size of the magazine will not affect the size and the gripping of the pistol grip. In addition, except for the pistol, the structure provided by the present disclosure may also be applied to the guns such as rifles, the length of the gun barrel can be increased with the same total length, so that the ballistic performance can be improved with the same portability, or the length can be shortened with the same gun barrel length, and the portability can be improved with the same ballistic performance.

BRIEF DESCRIPTION OF THE DRAWINGS

To describe the technical solutions in the embodiments of the present disclosure or in the prior art more clearly, the following briefly introduces the accompanying drawings required for describing the embodiments. Apparently, the accompanying drawings in the following description show merely some embodiments of the present disclosure, and those of ordinary skill in the art may still derive other drawings from these accompanying drawings without creative efforts.

Figure 1:
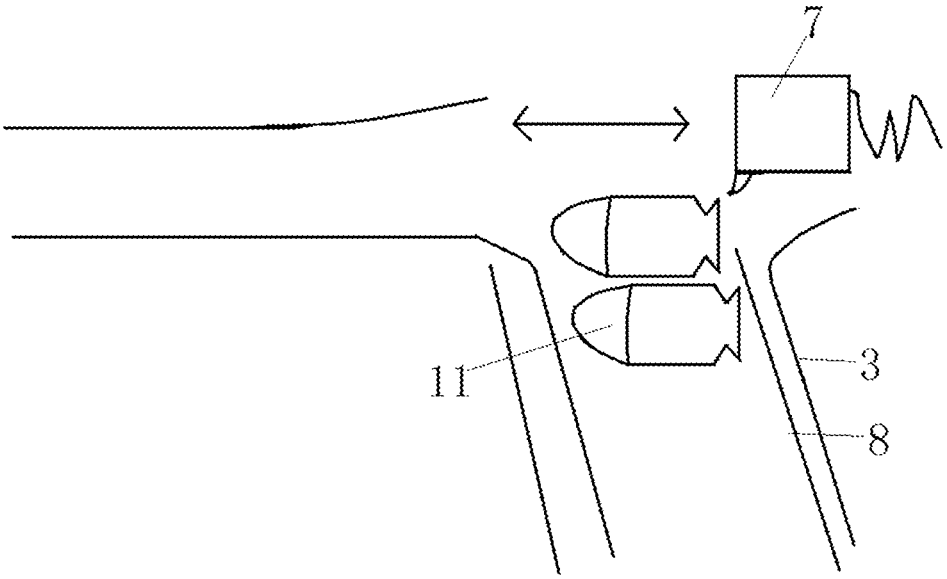
FIG. 1 is a structure diagram of a traditional self-loading pistol.

In the drawings: 100—novel cartridge feeding system for gun; 1—gun barrel; 2—chamber; 3—grip; 4—trigger set; 5—feeding rail upper part; 501—ejector part; 502—ejector port; 503—feeding rail contraction part; 504—feeding rail transition part; 505—feeding rail rear part; 506—feeding rail end part; 6—feeding rail lower part; 7—bolt; 8—magazine; 9—rotatable feeding ramp; 901—connecting rod part; 902—baffle part; 10—movable cartridge extraction/pushing hook; 11—cartridge.

DETAILED DESCRIPTION OF THE EMBODIMENTS

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by those of ordinary skill in the art based on the embodiments of the present disclosure without creative efforts shall fall within the protection scope of the present disclosure.

An objective of the present disclosure is to provide a novel cartridge feeding system for a gun to solve the problem in the prior art. A magazine is separately arranged in front of a trigger set, and thus the size of the magazine can be increased without being constrained by the grip, and the size of cartridge can be increased without increasing the size of the gun and reducing the length of the gun barrel. Moreover, the magazine is located in front of the grip, and unlike the situation of using a bullpup design, the recoil axis and the barrel pointing of the pistol are prevented from being affected by the magazine which blocks the arm.

To make the objectives, features and advantages of the present disclosure more apparently and understandably, the following further describes the present disclosure in detail with reference to the accompanying drawings and the specific embodiments.

Figure 2:
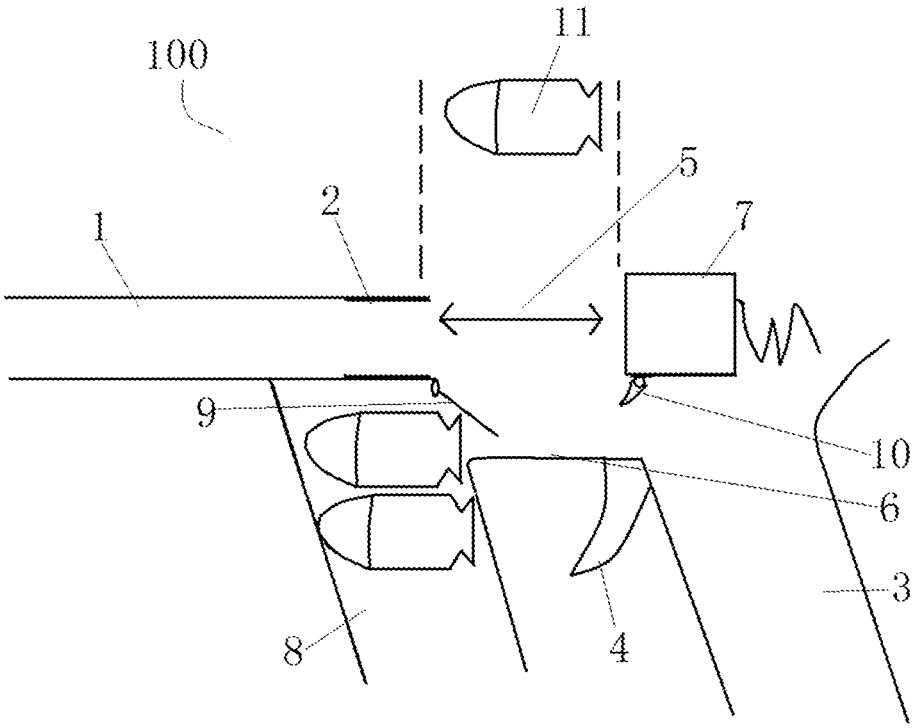
FIG. 2 is a structure diagram of a novel cartridge feeding system for a gun in accordance with the present disclosure.
Figure 3:
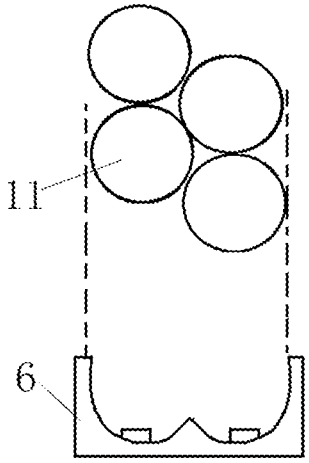
FIG. 3 is a front view of a feeding rail lower part.
Figure 4:
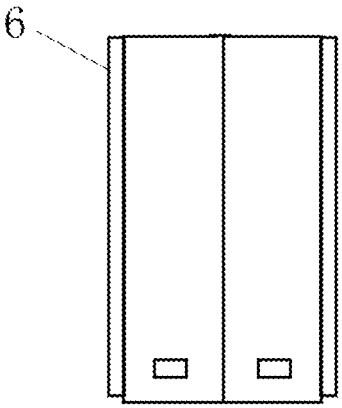
FIG. 4 is a top view of a feeding rail lower part.
Figure 5:
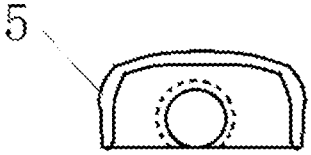
FIG. 5 is a front view of a feeding rail upper part.
Figure 6:
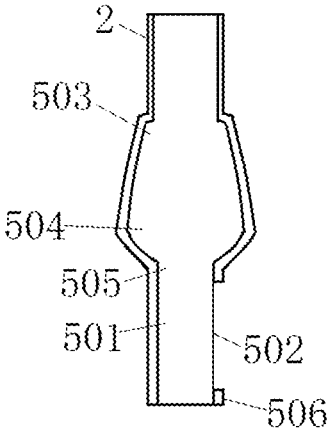
FIG. 6 is a top view of a feeding rail upper part.
Figure 7:
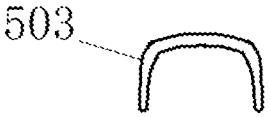
FIG. 7 is a schematic diagram of a radial section of a feeding rail contraction part.
Figure 8:
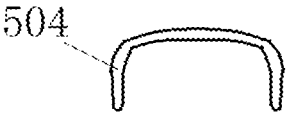
FIG. 8 is a schematic diagram of a radial section of a feeding rail transition part.
Figure 9:
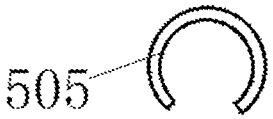
FIG. 9 is a schematic diagram of a radial section of a feeding rail rear part.
Figure 10:
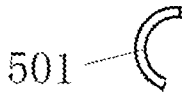
FIG. 10 is a schematic diagram of a radial section of an ejector part.
Figure 11:
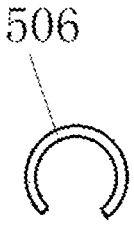
FIG. 11 is a schematic diagram of a radial section of a feeding rail end part.
Figure 12:
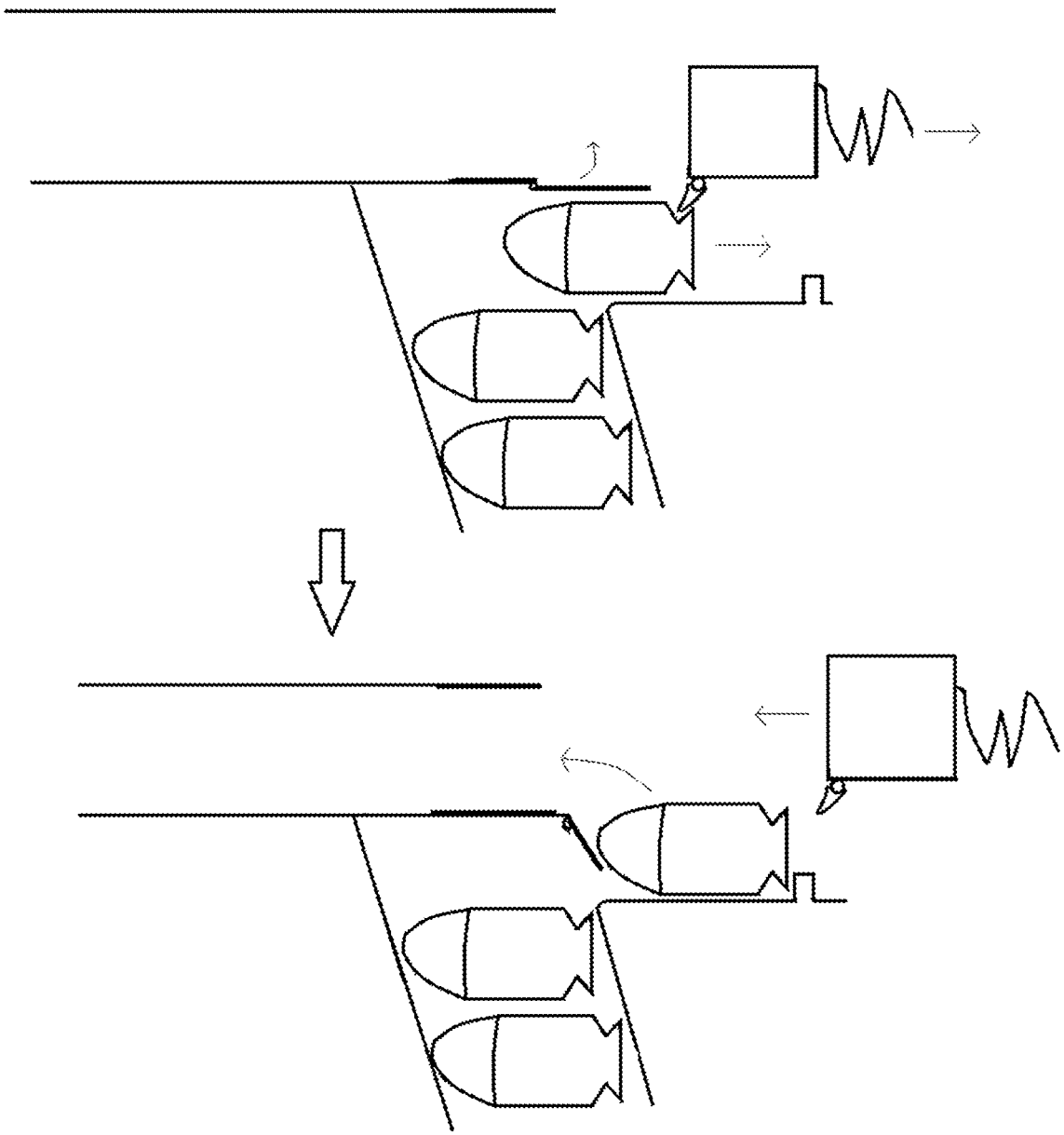
FIG. 12 is a structure diagram of a working process of a novel cartridge feeding system for a gun in accordance with the present disclosure.
Figure 13:
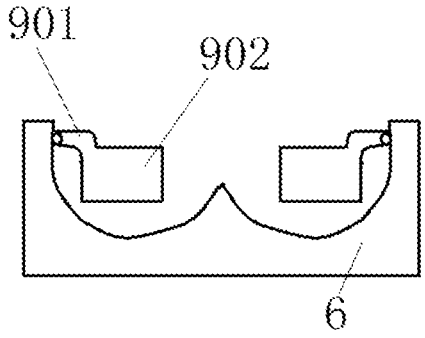
FIG. 13 is a sectional view of a rotatable feeding ramp in accordance with the present disclosure.

As shown in FIG. 2, a novel cartridge feeding system for a gun 100 is provided, including a gun barrel 1, a chamber 2, a grip 3, and a trigger set 4. A feeding rail is arranged between the grip 3 and the chamber 2. The feeding rail includes a feeding rail upper part 5 and a feeding rail lower part 6 which are connected with each other. The central line of the feeding rail upper part 5 coincides with the central line of the chamber 2. The trigger set 4 is located at the bottom of the feeding rail lower part 6, and one end, away from the grip 3, of the trigger set 4 is provided with a magazine 8. The upper side of the magazine 8 is connected to the inner bottom of the feeding rail lower part 6, a rotatable feeding ramp 9 is hinged to the bottom of one end, close to the feeding rail, of the chamber 2, and the rotatable feeding ramp 9 can move up and down in the feeding rail around its hinge point. A bolt 7 is movably arranged in the feeding rail upper part 5, a movable cartridge extraction/pushing hook 10 is hinged to the bottom of one end, close to the chamber 2, of the bolt 7, and the bolt 7 can move horizontally on the feeding rail upper part 5. FIG. 1 is a structure diagram of a traditional self-loading pistol structure. The magazine 8 is located in a grip 3, the cartridge feeding refers to that a bolt 7 directly pushes the cartridge 11 forwards to enter the chamber for cartridge feeding, the defect is that a cartridge storage device (magazine as an example) must be located behind the chamber to make the gun structure have a certain limitation, leading to the situation that the pistol cartridges are hard to increase their size to deal with the rapidly developed body armor. In a case that the cartridge is sized up, the overall size of the grip is increased as the cartridge storage device, the bolt 7 and the gun barrel need to move forwards. FIG. 2 is a schematic diagram of a novel cartridge feeding system for a gun. In accordance with the present disclosure, the double row double feed magazine structure is taken as an example for illustration, it can be seen that the position of the bolt 7 and the length of the gun barrel 1 have no obvious change on the premise that the size of the overall gun has no obvious change, but the magazine 8 is located in front of the trigger set 4, so that the size of the pistol is not constrained by the grip 3, and the size increase of the cartridge 11 becomes possible. Moreover, in a case of using the same cartridge 11, the size is not obviously increased, and the length of the gun barrel 1 is not obviously reduced, and therefore, the portability and acceleration time of the cartridge 11 are not affected due to the use of the new structure. The trigger set, the bolt, the bolt self-loading structure and other parts without innovation will not be described, and may apply any known structures theoretically.

Referring to FIG. 3, FIG. 4, FIG. 5, FIG. 6, FIG. 7, FIG. 8, FIG. 9, FIG. 10, FIG. 11, FIG. 12, FIG. 13, FIG. 14, and FIG. 15, the chamber 2 is a hollow cylindrical structure. The feeding rail upper part 5 includes an integrally formed gradual-change part with an open bottom, one end of the gradual-change part is connected to the chamber 2, the other end of the gradual-change part is provided with an ejector part 501 for the empty case, and an ejector port 502 is formed in one side of the ejector part 501. The height of the ejector port 502 is larger than the diameter of the cartridge 11, and the length of the ejector port 502 is larger than the length of the cartridge 11. The gradual-change part includes a feeding rail contraction part 503 connected to the chamber 2, one end, far away from the chamber 2, of the feeding rail contraction part 3 is provided with a feeding rail transition part 504 and a feeding rail rear part 505 in sequence, the cross sections of the feeding rail contraction part 503 and the feeding rail transition part 504 are both inverted U-shaped, and the width of the feeding rail transition part 504 is equal to that of the feeding rail lower part 6. The longitudinal section of the feeding rail rear part 505 is a circular structure with an open bottom. The bolt 7 can reciprocate in the feeding rail rear part 505, the feeding rail rear part 505 is connected to the ejector part 501, and the tail end of the ejector part 501 is a feeding rail end part 506.

Figure 14:
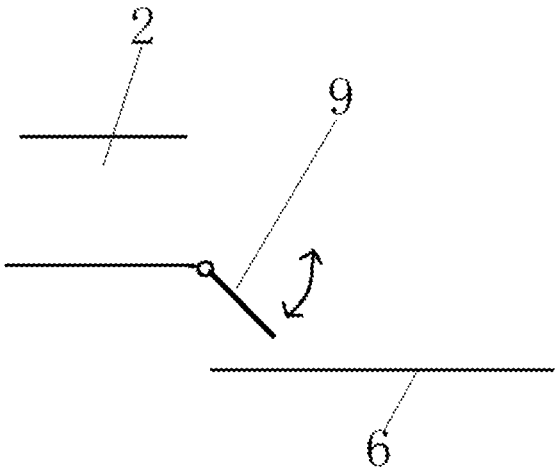
FIG. 14 is a side view of a rotatable feeding ramp in accordance with the present disclosure.
Figure 15:
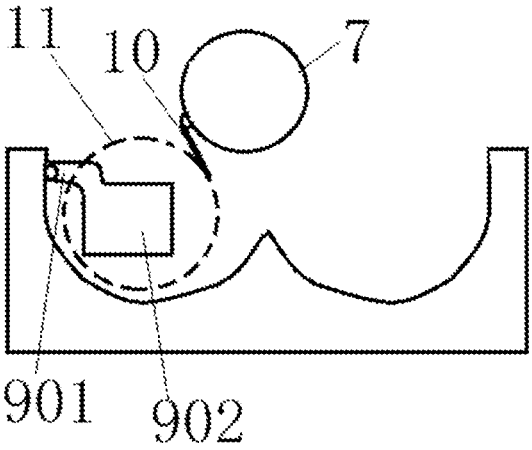
FIG. 15 is a schematic diagram illustrating the positional relationship between a rotatable feeding ramp and a bolt in accordance with the present disclosure.

The rotatable feeding ramp 9 includes a connecting rod part 901 hinged to the tail end of the chamber 2, one end of the connecting rod part 901 away from the hinge point with the chamber 2 is integrally formed with a baffle part 902, and a gap is provided between a vertical projection of one side, away from the connecting rod part 901, of the baffle part 902 and a vertical projection of the movable cartridge extraction/pushing hook 10, thus the rotatable feeding ramp 9 is free of interfering the reciprocation movement of the bolt 7 and the movable cartridge extraction/pushing hook 10. Referring to a sectional view and a side view of the rotatable feeding ramp 9, as shown in FIG. 14 and FIG. 14, the arrow range is the rotatable range of the rotatable feeding ramp 9, the rotatable feeding ramp 9 should be at the position shown in FIG. 14 when it is not stressed. When the cartridge is deflected when extracted out, and is reset after the cartridge extraction is finished. An inclined plane is created to make the operation of pushing the cartridge from the feeding rail lower part 6 into the feeding rail upper part 5 is feasible, which has the same function as the feeding ramp of the traditional cartridge feeding structure, but the cartridge is allowed to pass from the front magazine to the feeding rail lower part 6. The cartridge keeps still when pushed forwards from the rear feeding rail lower part 6 so as to be lifted to enter the feeding rail upper part 5.

In accordance with the present disclosure, when moving backwards, the bolt not only performs case extraction and ejection like the traditional bolt, but also extracts the to-be-fired cartridge from the front magazine to enter the feeding rail lower part 6, and then the bolt 7 moves forwards to push the cartridge, the cartridge is tilted under the interference of the reset rotatable feeding ramp 9 to enter the feeding rail upper part 5 and then enter the chamber 2 to be fired. In this process, the bolt 7 moves back and forth, when the bolt 7 moves backwards, the movable cartridge extraction/pushing hook 10 extracts the cartridge from the magazine 8, and the rotatable feeding ramp 9 is pushed open to allow the cartridge to pass through to enter the feeding rail lower part 6, and then the bolt 7 continues to move backwards, making the movable cartridge extraction/pushing hook 10 separated from the cartridge. Then the bolt 7 is self-loaded, the movable cartridge extraction/pushing hook 10 pushes the cartridge entering the feeding rail lower part 6 forwards, and at the moment, the rotatable feeding ramp 9 has recovered to a default state. When the cartridge entering the lower part of the feeding rail 6 is pushed to the rotatable feeding ramp 9 by the bolt 7, the cartridge can continue to move forwards along the upper end face of the rotatable feeding ramp 9 while being lifted up due to mechanical imitation, so as to enter the feeding rail upper part 5 and to continue to move forwards to enter the chamber 2.

In the description of the present disclosure, it needs to be noted that the orientation or positional relationship indicated by terms "center", "top", "bottom", "left", "right", "vertical", "horizontal", "inside", "outside" is based on the orientation or positional relationship shown in the drawings only for convenience of description of the present disclosure and simplification of description rather than indicating or implying that the device or element referred to must have a particular orientation, be constructed and operate in a particular orientation, and thus are not to be construed as limiting the present disclosure. Furthermore, the terms "first" and "second" are used for descriptive purposes only and are not to be construed as indicating or implying relative importance.

Several examples are used for illustration of the principles and implementation methods of the present disclosure. The description of the embodiments is merely used to help illustrate the method and its core principles of the present disclosure. In addition, those of ordinary skill in the art can make various modifications in terms of specific embodiments and scope of application in accordance with the teachings of the present disclosure. In conclusion, the content of this specification shall not be construed as a limitation to the present disclosure.

What is claimed is:

1. A novel cartridge feeding system for a gun, comprising a gun barrel, a chamber, a grip, and a trigger set, wherein a feeding rail is arranged between the grip and the chamber, the trigger set is located at the bottom of the feeding rail, and one end, away from the grip, of the trigger set is provided with a magazine; the upper side of the magazine is connected to the inner bottom of the feeding rail, and a rotatable feeding ramp is hinged to the bottom of one end, close to the feeding rail, of the chamber; and a bolt is movably arranged in an upper half part of the feeding rail, and a movable cartridge extraction/pushing hook is hinged to the bottom of one end, close to the chamber, of the bolt.

2. The novel cartridge feeding system for a gun according to claim 1, wherein the feeding rail comprises a feeding rail upper part and a feeding rail lower part which are connected with each other, the central line of the feeding rail upper part coincides with the central line of the chamber, and the bolt is able to move horizontally on the feeding rail upper part.

3. The novel cartridge feeding system for a gun according to claim 2, wherein the feeding rail upper part comprises an integrally formed gradual-change part with an open bottom, one end of the gradual-change part communicates with the chamber, and the other end of the gradual-change part is provided with an ejector part for an empty case; and an ejector port is formed in one side of the ejector part.

4. The novel cartridge feeding system for a gun according to claim 3, wherein the gradual-change part comprises a feeding rail contraction part connected to the chamber, one end, far away from the chamber, of the feeding rail contraction part is provided with a feeding rail transition part and a feeding rail rear part in sequence, the cross sections of the feeding rail contraction part and the feeding rail transition part are both inverted U-shaped, and the width of the feeding rail transition part is equal to that of the feeding rail lower part; the longitudinal section of the feeding rail rear part is a circular structure with an open bottom; and the bolt is able to reciprocate in the feeding rail rear part.

5. The novel cartridge feeding system for a gun according to claim 1, wherein the rotatable feeding ramp comprises a connecting rod part hinged to a tail end of the chamber, one end of the connecting rod part away from the hinge point with the chamber is integrally formed with a baffle part, and a gap is provided between a vertical projection of one side, away from the connecting rod part, of the baffle part and a vertical projection of the movable cartridge extraction/pushing hook.

6. The novel cartridge feeding system for a gun according to claim 3, wherein the height of the ejector port is greater than the diameter of the cartridge, and the length of the ejector port is greater than the length of the cartridge.

* * * * *